United States Patent [19]

Aoki

[11] Patent Number: 4,972,211

[45] Date of Patent: Nov. 20, 1990

[54] INK JET RECORDER WITH ATTENUATION OF MENISCUS VIBRATION IN A EJECTION NOZZLE THEREOF

[75] Inventor: Makoto Aoki, Yokohama, Japan

[73] Assignee: Canon Kabushiki Kaisha, Tokyo, Japan

[21] Appl. No.: 328,708

[22] Filed: Mar. 27, 1989

Related U.S. Application Data

[63] Continuation of Ser. No. 63,066, Jun. 17, 1987, abandoned.

[30] Foreign Application Priority Data

Jun. 20, 1986 [JP] Japan ..... 61-142786

[51] Int. Cl.[5] ..... B41J 2/045

[52] U.S. Cl. ..... 346/140 R

[58] Field of Search ..... 346/140

[56] References Cited

U.S. PATENT DOCUMENTS

| | | | |
|---|---|---|---|
| 3,060,429 | 10/1962 | Winston . | |
| 3,298,030 | 1/1967 | Lewis et al. . | |
| 3,596,275 | 7/1971 | Sweet . | |
| 3,683,212 | 8/1972 | Zoltan | 310/8.3 |
| 3,747,120 | 7/1973 | Stemme | 346/75 |
| 3,832,579 | 8/1974 | Arndt | 310/8.1 |
| 3,946,398 | 3/1976 | Kyser et al. | 346/1 |
| 4,104,646 | 8/1978 | Fischbeck | 346/140 |
| 4,161,670 | 7/1979 | Kern | 310/317 |
| 4,284,996 | 8/1981 | Greve | 346/140 R |
| 4,369,455 | 1/1983 | McConica | 346/140 |
| 4,424,520 | 1/1984 | Matsuda | 346/140 |
| 4,577,201 | 3/1986 | Morakami | 346/140 |
| 4,639,735 | 1/1987 | Yamamoto . | |
| 4,714,935 | 12/1987 | Yamamoto . | |
| 4,717,927 | 1/1988 | Sato | 346/140 R |
| 4,743,924 | 5/1988 | Scardovi | 346/140 |
| 4,752,790 | 6/1988 | Scardovi | 346/140 |

OTHER PUBLICATIONS

Drago et al.; Pulse Cancellation in Drop-On-Demand; IBM TDB, vol. 27, No. 6, Nov. 1984, pp. 3266-3267.

*Primary Examiner*—Joseph W. Hartary

*Attorney, Agent, or Firm*—Fitzpatrick, Cella, Harper & Scinto

[57] ABSTRACT

There is disclosed an ink jet recorder for applying an electrical signal to a piezoelectric element to change a volume of an ink chamber of a record head to discharge an ink droplet from an orifice of a nozzle toward a record medium, comprises a piezoelectric element drive unit for generating a pulse wave as the electrical signal, the pulse wave causing rapid decrease of the volume of the ink chamber to discharge the ink droplet from the orifice, and after a predetermined time t, causing increase of the volume of the ink chamber.

8 Claims, 3 Drawing Sheets

INK JET RECORDER WITH ATTENUATION OF MENISCUS VIBRATION IN A EJECTION NOZZLE THEREOF

This application is a continuation of application Ser. No. 063,066 filed June 17, 1987, now abandoned.

BACKGROUND OF THE INVENTION

1. Field of the Invention

The present invention relates to an ink jet recorder.

2. Related Background Art

Many systems for the ink jet recording have been known. They are classified into three major classes, that is, (1) continuous jet type, (2) impulse type (on-demand type) and (3) electrostatic attraction type.

In the continuous jet type, continuously discharged ink is charged and deflected to record data. Accordingly, the recorder is complex and requires recovery of ink and a cleaning device. Such type of recorder is disclosed in U.S. Pat. Nos. 3,298,030 or 3,596,275.

In the electrostatic attraction type recorder, the structure is relatively simple but requires a high voltage. Accordingly, there is a problem in energy saving and safety. Further, the number of materials which can be used as ink is restricted in view of the necessity that it exhibit conductivity, and frequency response is poor. Such type of recorder is disclosed in U.S. Pat. No. 3060429.

On the other hand, in the on-demand type recorder, an ink droplet is discharged by a discharge energy supplied by energy generation means such as an electromechanical transducer or electro-thermal transducer only when it is required. Accordingly, the structure is very simple and suitable for the recorder. Such type recorder is disclosed in U.S Pat. Nos. 3,683,212, 3,832,579, No. 3,747,120, and No. 3,946,398.

However, as shown in FIG. 1, in the on-demand type ink jet recorder, particularly that which uses a piezoelectric electro-mechanical element as the energy generation means, a resonance frequency exists in a discharge velocity of the ink droplet in a high drive frequency range. If the ink droplet is discharged at such a resonance frequency, the discharge state is very unstable.

A reason for such a resonance frequency may be that a pressure wave generated by the piezoelectric element, when the ink droplet is discharged acts not only toward the nozzle 1 (in the direction of discharge of the ink droplet) but also in the opposite direction, toward the ink supply path. This pressure wave is reflected at the rear and the reflected wave thus affects to the discharge state of the next ink droplet.

Accordingly, by observing a meniscus after the ink discharge, the presence of the pressure wave is recognized. FIG. 2 illustrates meniscus vibration. The local unevenness of a characteristic curve of FIG. 2 may be due to the reflection wave.

A period t of resonance is a function of the velocity of sound c in the ink in the nozzle and a length l of the nozzle, $$t = \frac{4l}{c} \quad (1)$$

It substantially corresponds to a resonance frequency measured in FIG. 1 and a period of unevenness of the curve shown in FIG. 2.

If the reflection wave is large at the point R in FIG. 2, the vibrating meniscus moves past the orifice and a required ink droplet 101 as well as an extraneous droplet 102 are discharged from the head end 103 as shown in FIG. 3. Such a discharge state is very unstable and the droplet 102 degrades the print quality. Accordingly, those problems must be solved.

In order to stabilize the discharge of the ink droplet, it is necessary to prevent the reflection wave from moving toward the front of the nozzle. To this end, the pressure wave propagated toward the back of the nozzle and the reflection wave should be attenuated in the ink. Such attenuation may be attained by increasing the viscosity of the ink or increasing the length of the nozzle. In both methods, the pressure wave is attenuated but the viscosity resistance in the nozzle increases or the frequency response is degraded.

In the past, the frequency response is weighted and the ink viscosity is selected rather low and the nozzle length is selected rather short. As a result, the affect of the reflection wave is significant and the stability of the discharge of the ink droplet is not good.

SUMMARY OF THE INVENTION

It is an object of the present invention to provide an ink jet recorder which discharges ink droplets to record data with high reproducibility, has a high frequency response and has a high tonality.

In order to achieve the above object, in accordance with the ink jet recorder which applies an electrical signal to a piezoelectric element to change a volume of an ink chamber of a record head to discharge an ink droplet from an orifice of a nozzle toward a record medium, piezoelectric element drive means is provided to generate a pulse for increasing the volume of the ink chamber a predetermined time t after the discharge of the ink droplet from the orifice by suddenly reducing the volume of the ink chamber.

DETAILED DESCRIPTION OF THE PREFERRED EMBODIMENTS

Figure 1:
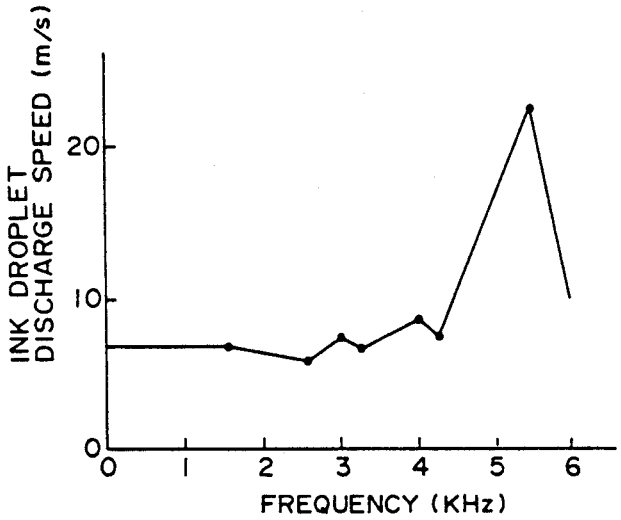
FIG. 1 PRIOR ART
FIG. 1 shows a relationship between a drive frequency of a record head and an ink droplet discharge speed.
Figure 2:
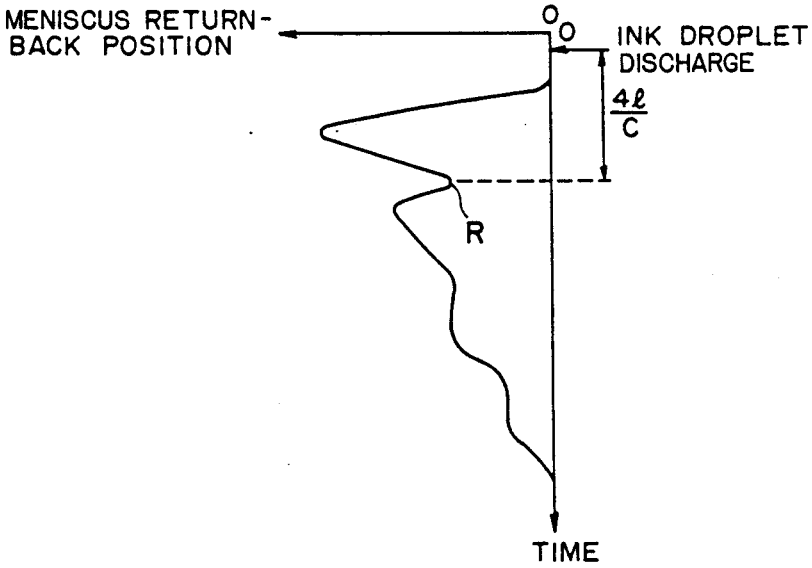
FIG. 2 PRIOR ART
FIG. 2 shows a characteristic curve of a meniscus vibration.
Figure 3:
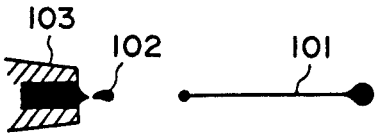
FIG. 3 PRIOR ART
FIG. 3 shows a sectional view illustrating unstable ink droplet discharge.
Figure 4:
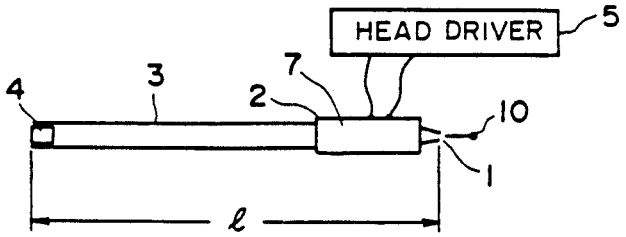
FIG. 4 PRIOR ART
FIG. 4 shows a front view of a record head used in one embodiment of the present invention.

FIG. 4 shows a structure of an ink jet record head used in the present embodiment. Numeral 1 denotes an orifice and numeral 2 denotes a cylindrical piezoelectric element. For example, an end of a glass nozzle 3 is tapered to form the orifice 1 to which the cylindrical piezoelectric element 2 is bonded. Numeral 4 denotes a filter arranged at a rear end of the nozzle 3, numeral 5 denotes a head driver for applying a driver pulse to the cylindrical piezoelectric element 2, and numeral 7 denotes an ink chamber in the record head. Ink is supplied through the filter 4 and the nozzle (ink supply path ) 3.

Figure 5A:
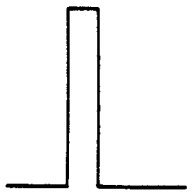
FIG. 5A PRIOR ART
FIG. 5A shows a waveform of a drive pulse in a prior art recorder.

When a positive pulse voltage shown in FIG. 5A is applied to the cylindrical piezoelectric element 2 from the head driver 5, a volume of the ink chamber 7 in which the cylindrical piezoelectric element is mounted changes in accordance with the pulse voltage and an ink droplet 10 is discharged from the orifice 1. However, this pressure wave is reflected by the front end and rear end of the nozzle 3 and the reflected wave vibrates the meniscus 4l/c after the ink discharge (where l is a length of the nozzle, and c is the velocity of sound in the ink in the nozzle 3). Since c is not a velocity in an infinitely wide space but the sound velocity in the ink in the nozzle 3, c is smaller than the sound velocity in such a wide space because of affect of the tube wall of the nozzle 3.

Figure 5B:
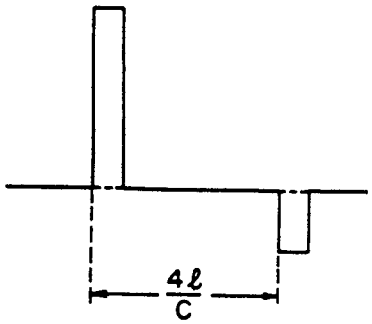
FIG. 5B shows a waveform of a drive pulse in the embodiment of the present invention.

As shown in FIG. 5B, if a pulse wave which causes application of a negative pulse voltage to increase the volume of the ink chamber 7 is applied to the cylindrical piezoelectric element 2 from the head driver 4l/c after the application of the positive pulse which causes the discharge of the ink droplet, the abnormal vibration of the meniscus 4l/c after the discharge of the ink is suppressed and the discharge is stabilized, as was proved by an experiment.

Since optimum values of the voltage and the pulse width of the negative pulse voltage after 4l/c period vary with the degree of reflected wave, they should be corrected in accordance with the ink viscosity, head structure, positive pulse voltage and pulse width.

Figure 6:
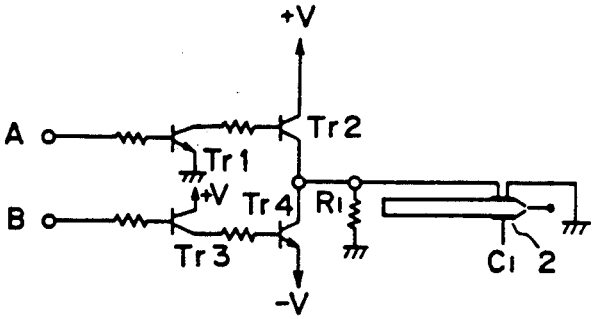
FIG. 6 shows a circuit diagram of the embodiment of the present invention.

FIG. 6 shows a drive circuit of the head driver 5 of the embodiment.

As shown in FIG. 6, transistors $Tr_1$–$Tr_4$ are connected as shown and a common connecting point of a collector of the transistor $Tr_2$ which is an output terminal and a collector of the transistor $Tr_4$ is connected to the cylindrical piezoelectric element 2 and also grounded through a resistor R1.

Figure 7:
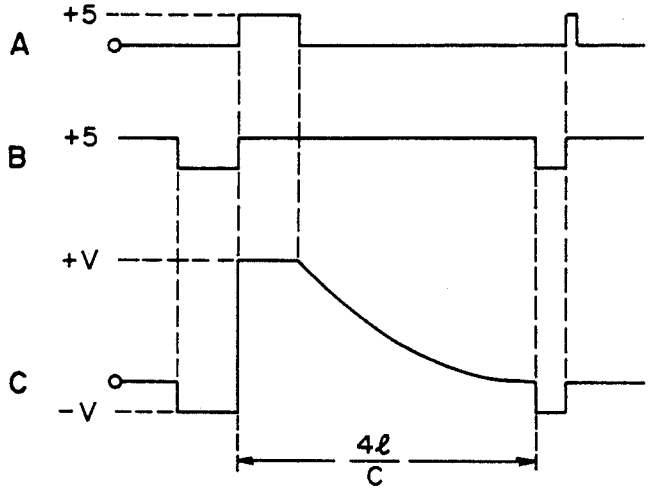
FIG. 7 shows waveforms for illustrating timing of an input signal and the drive pulse in the embodiment of FIG. 6, and FIGS. 8, 9 and 10 show waveforms of drive pulses in other embodiments of the present invention.

As shown in FIG. 7, when pulses A and B are applied to the driver of FIG. 6, the transistors $Tr_1$ to $Tr_4$ are turned on and a waveform shown in C is produced and applied to the piezoelectric element 2.

The drive pulse c comprise a negative pulse followed by a positive pulse to increase a discharge speed of the ink droplet. The negative pulse wave after the 4l/c period stabilizes the discharge.

Other embodiments are explained with reference to the waveforms of drive pulses shown in FIGS. 8 to 10.

Figure 8:
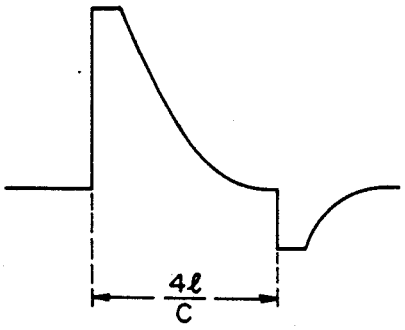

In the drive pulse waveform shown in FIG. 8, the ink chamber 7 is rapidly pressurized through the cylindrical piezoelectric element 2, then the positive pressure is gradually decreased, a negative pulse wave is applied, and then the negative pressure is gradually decreased. As a result, air bubbles are not taken in and stable discharge is attained by the orifice 1. The negative pulse wave is applied 4l/c after the application of the positive pulse, as is done in the above embodiment.

Figure 9:
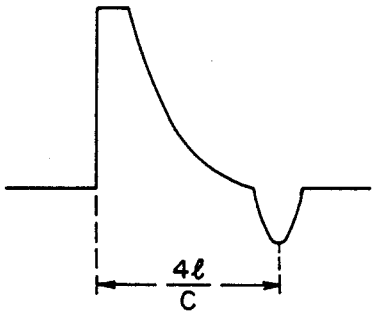

In the drive pulse waveform shown in FIG. 9, a negative pulse is a sine wave and a negative pulse after the 4l/c period stabilizes the discharge.

Figure 10:
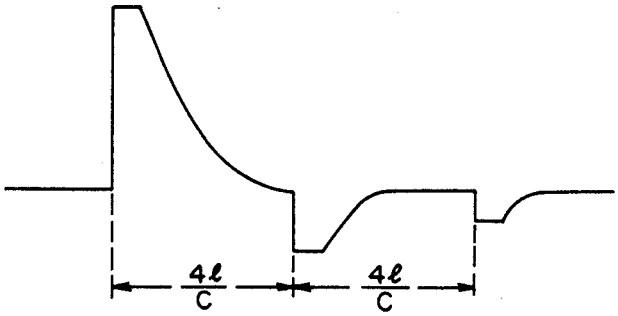

In the drive pulse waveform shown in FIG. 10, n negative pulses (n=1, 2, 3, ...) are applied at an interval of 4l/c after the application of a positive pulse. If the reflected wave is hardly attenuated in the nozzle 3, the drive pulse waveform as shown in FIG. 10 may be used. In this case, as n increases, the negative pulse voltage or width should be reduced. By the use of such waveform, stable discharge is attained even when the reflected wave is large, that is, the ink viscosity is low, the nozzle 3 is short and the attenuation of the pressure wave is low.

In the embodiments of the present invention, the discharge of the ink droplet is stabilized and the drive frequency of the drive pulse applied to the piezoelectric element 2 may be higher than that in the prior art recorder.

In accordance with the present invention, in the ink jet recorder which applies the electrical signal to the piezoelectric element to change the volume of the ink chamber to discharge the ink droplet from the orifice, the electrical signal applied to the piezoelectric element is a pulse wave which causes the rapid decrease of the volume of the ink chamber to discharge the ink droplet from the orifice, and then causes the increase of the volume of the ink chamber after the predetermined time period. Accordingly, the ink jet recording having high frequency response and high discharge stability is attained.

In the ink jet recorder of the present invention which applies the electrical signal to the piezoelectric element to change the volume of the ink chamber and discharge the ink droplet from the orifice to record data, the pulse wave which increases the volume of the ink chamber the predetermined time after the discharge of the ink droplet from the orifice by suddenly decreasing the volume of the ink chamber, is applied to the piezoelectric element. Accordingly, ink jet recording is attained with high frequency response and high discharge stability.

In the above embodiment, the length l of the nozzle indicates the length from the liquid inlet port to the side edge of the orifice of the member forming the nozzle. In this case, the existence of a filter in the liquid path can be substantially ignored because the flow resistance in the liquid passing through the orifice is much larger than that of the liquid passing through the filter and the difference between the resistances therebetween is large.

Although the absolute value of the voltage of the reversed pulse which is applied to the element after the lapse of a predetermined time period is properly selected in accordance with the discharge characteristics of the device and the shape of the member forming the device, the absolute value is preferably smaller than the absolute value of the voltage of the discharge pulse.

I claim:

1. An ink jet recorder comprising:

a recording head including (a) a nozzle capable of being filled with ink, the speed of sound of the ink in said nozzle being c, wherein said nozzle terminates at one end at an orifice for forming an ink meniscus and at another end at a filter through which ink is introduced into said nozzle, the length of a said nozzle including said filter being l, and wherein said nozzle has an ink chamber intermediate said ends, and (b) a piezoelectric element for changing the volume of said ink chamber in response to an electrical signal applied to said piezoelectric element to discharge an ink droplet from said orifice toward a recording medium; and piezoelectric element drive means connected to said piezoelectric element for applying thereto a pulse wave electrical signal including a first pulse and a second pulse, wherein the first pulse causes a rapid decrease in the volume of said ink chamber and moves the ink meniscus past said orifice to discharge an ink droplet therefrom and the second pulse causes a rapid increase in the volume of said ink chamber at a time $t=4l/c$ after the rapid decrease in volume caused by the first pulse, wherein the second pulse has a width that is smaller than that of the first pulse and the second pulse has a voltage smaller than that of the first pulse, whereby the resonant vibration of the ink meniscus occurring at a period t as a result of the initial meniscus movement caused by the first pulse is suppressed.

2. A recorder according to claim 1, wherein said nozzle is straight.

3. A recorder according to claim 1, wherein the absolute value of the second pulse for increasing the volume of said ink chamber is smaller than that of the first pulse for decreasing the volume of said ink chamber.

4. A recorder according to claim 1, wherein the polarity of the voltage of the second pulse for increasing the volume of said ink chamber is opposite to that of the first pulse for decreasing the volume of said ink chamber.

5. A recorder according to claim 1, wherein the second pulse for increasing the volume of said ink chamber is applied plural times.

6. A recorder according to claim 1, wherein the second pulse for increasing the volume of said ink chamber is applied plural times at intervals of $4l/c$.

7. A recorder according to claim 1, wherein the pulse wave generated by said piezoelectric element drive means comprises a first square wave for causing the decrease of the volume of said ink chamber and a second square wave of opposite polarity for causing the increase of the volume of said ink chamber.

8. A recorder according to claim 7, wherein the magnitude of the first square wave is larger than the magnitude of the second square wave.

* * * * *

UNITED STATES PATENT AND TRADEMARK OFFICE

CERTIFICATE OF CORRECTION

PATENT NO. : 4,972,211

DATED : November 20, 1990

INVENTOR(S) : MAKOTO AOKI

It is certified that error appears in the above-identified patent and that said Letters Patent is hereby corrected as shown below:

On the title page:

In [54] Title:

"A" should read --AN--.

In [56] References Cited:

"Morakami" should read --Murakami--.

In [57] Abstract:

Line 1, "There is disclosed an" should read --An--.

COLUMN 1:

Line 3, "A" should read --An--;

Line 13, "the" should be deleted;

Line 21, "or" should read --and--;

Line 29, "3060429." should read --3,060,429.--;

UNITED STATES PATENT AND TRADEMARK OFFICE

CERTIFICATE OF CORRECTION

PATENT NO. 4,972,211 Page 2 of 2

DATED November 20, 1990

INVENTOR(S) MAKOTO AOKI

It is certified that error appears in the above-identified patent and that said Letters Patent is hereby corrected as shown below:

Line 47, "," (comma) should be deleted; and

Line 52, "to" should be deleted.

COLUMN 2:

Line 4, "end 103" should read --end 103,--; and

Line 20, "affect" should read --effect--.

COLUMN 3:

Line 3, "driver pulse" should read --drive pulse--; and

Line 20, "affect" should read --the effect--.

COLUMN 4:

Line 62, "a" should be deleted.

Signed and Sealed this

Twenty-fifth Day of August, 1992

*Attest:*

DOUGLAS B. COMER

*Attesting Officer*

*Acting Commissioner of Patents and Trademarks*